United States Patent [19]

Hunter

[11] 3,953,159

[45] Apr. 27, 1976

[54] INTERNAL COMBUSTION ENGINE

[76] Inventor: Lee Hunter, 13501 Ladue Road, Ladue, Mo.

[22] Filed: Jan. 20, 1975

[21] Appl. No.: 542,126

[52] U.S. Cl. ..... 418/61 R; 123/8.45
[51] Int. Cl.[2] ..... F02B 53/00; F04C 17/02
[58] Field of Search ..... 123/8.45; 418/58, 61 R, 418/64

[56] References Cited

UNITED STATES PATENTS

| | | | |
|---|---|---|---|
| 1,594,035 | 7/1926 | Bailey | 123/8.45 |
| 3,318,291 | 5/1967 | Hallenbeck et al. | 418/61 R X |
| 3,787,150 | 1/1974 | Sarieh | 123/8.45 X |
| 3,812,828 | 5/1974 | Griffiths | 418/61 R X |

FOREIGN PATENTS OR APPLICATIONS

| | | | |
|---|---|---|---|
| 164,947 | 12/1949 | Austria | 123/8.45 |

*Primary Examiner*—Carlton R. Croyle
*Assistant Examiner*—Michael Koczo, Jr.
*Attorney, Agent, or Firm*—Gravely, Lieder & Woodruff

[57] ABSTRACT

An internal combustion engine having a generally cylindrical chamber, and a similarly shaped piston carrying vanes that divide the chamber into distinct combustion cells, and a crankshaft with an operating connection to the piston such that orbiting motion of the piston is generated upon rotation of the crankshaft.

4 Claims, 10 Drawing Figures

INTERNAL COMBUSTION ENGINE

BRIEF SUMMARY OF THE INVENTION

This invention relates to improvements in internal combustion engines having an orbital piston constrained to move with an orbital motion and means to generate the orbital piston motion upon rotation of the crankshaft.

In my prior application for patent, Ser. No. 439,220, filed Feb. 4, 1974, I disclosed an internal combustion engine having an orbital core controlled as to its motion in the working chamber by a plurality of crankshafts that caused the core to orbit without rotation or wobble. The present engine employs a unique arrangement of gears that causes the piston to orbit in the chamber without rotation or wobble.

It is a general object of this invention to provide a more efficient non-reciprocating piston engine in which a generally cylindrical piston works in a generally cylindrical chamber without rotation or wobble, and to provide a gearing system between a crankshaft and the piston for generating the orbital motion of the piston concurrently with rotation of the crankshaft.

It is also an object of this invention to provide a piston having a base structure and separately formed and attached combustion face segments, and to provide means for accurately locating the face segments in spaced relation for the purpose of forming slots to receive vanes which delineate separate combustion cells.

A preferred embodiment of the present internal combustion engine comprises a frame forming a generally cylindrically shaped casing open in the central area and forming an annular combustion space, a piston member movable in the annular space, a crankshaft rotatively mounted in the structure of the frame, gears between the crankshaft and the piston member to prevent rotation thereof and establish orbital movement, vanes spaced about in the piston to define separate combustion cells, valves for controlling the operation of the engine, and an organization of cams, lifters, tappets and cam operating gears to operate the valves.

In the embodiment just described the piston member transmits the power from the fuel combustion in the respective cells to the crankshaft, and the gears control the motion of the piston so that the piston moves in an orbit in the casing without rotating or tilting, whereby the periphery of the piston has a working relationship with the walls of the casing during orbital displacement and the vanes do not pass across the inlet and exhaust passages.

More particularly the engine of this invention comprises a housing defining an annular chamber having a peripheral wall and spaced side face plates, said peripheral wall being formed with recessed flats in circumferentially spaced relation and one of said side face plates being formed with a geometric member located in the axial center of said annular chamber and formed with flat faces presented one to each of a similar number of faces formed in the periphery of the chamber, a piston movable in said annular chamber to surround said geometric member, a gear system between the crankshaft and the piston arranged such that said piston is constrained to move in an orbital path within said annular chamber, vanes in said piston dividing said annular chamber into cells equal in number to the number of flat faces, each vane extending through said piston and being engaged at one end in a flat face on the chamber wall and at its opposite end on a flat face of the geometric member and all of said vanes being movable from side-to-side on said flat faces as said piston orbits in said annular chamber, means to seal said vanes with said piston and to seal said piston with said side face plates, and valve means on said housing for each of said cells to admit a combustion medium and exhaust the products of combustion.

BRIEF DESCRIPTION OF THE DRAWINGS

A presently preferred embodiment of this invention is shown in the accompanying drawings, wherein.

DETAILED DESCRIPTION OF THE EMBODIMENT

Figure 1:
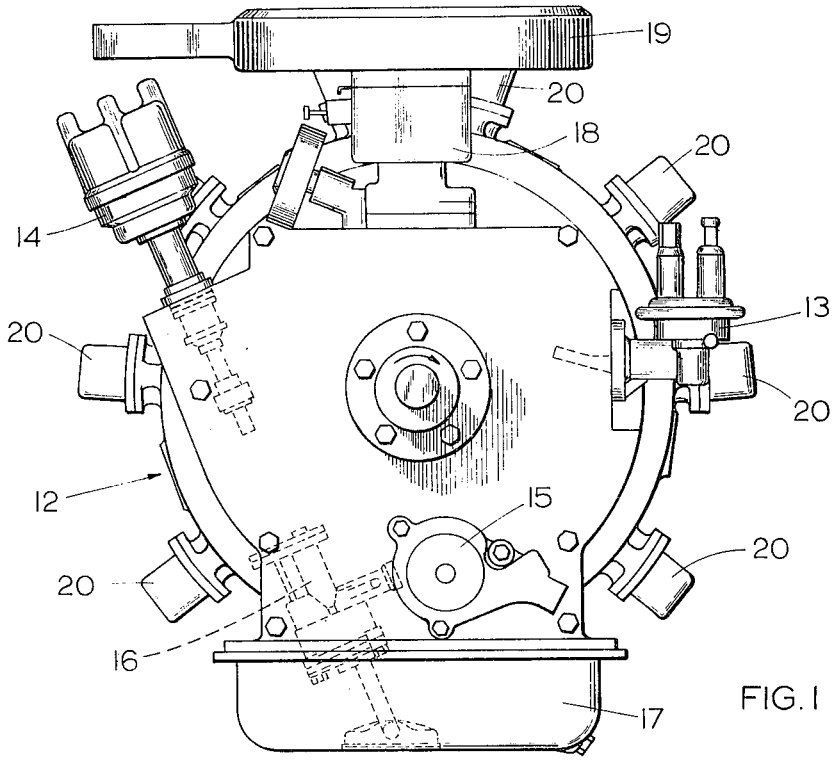
FIG. 1 is a front elevational view of the internal combustion engine showing the frame and accessory arrangement.

FIG. 1 presents the general arrangement of the engine frame 12 and accessories, such as a fuel pump 13, a distributor 14, water pump 15, and oil pump 16 within the frame so as to communicate with the oil pan 17. A carburetor 18 and air cleaner 19 are also shown, and circumferentially spaced around the frame 12 are valve covers 20.

Figure 3:
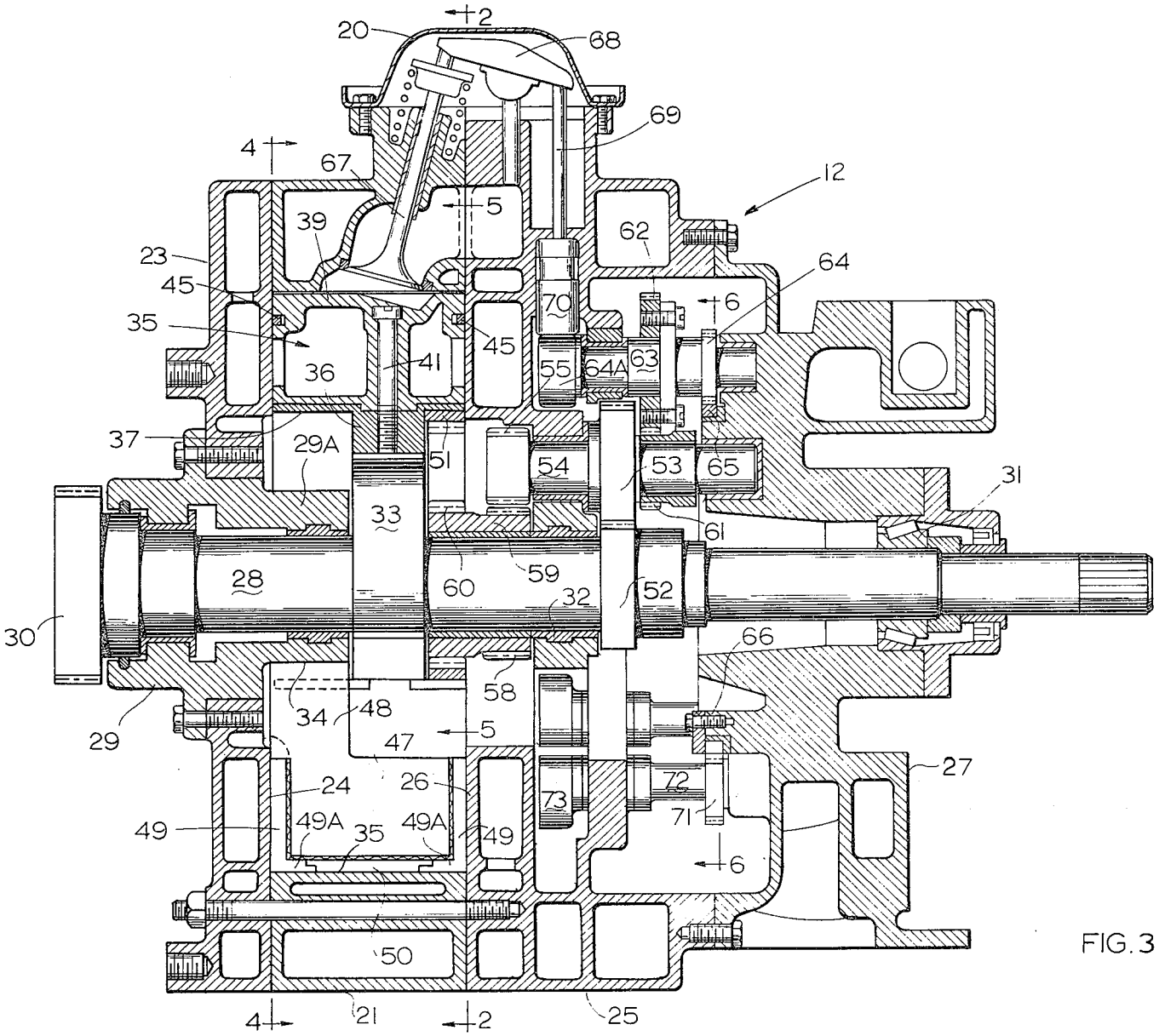
FIG. 3 is a longitudinal sectional view taken along the stepped line 3—3 in FIG. 2.
Figure 4:
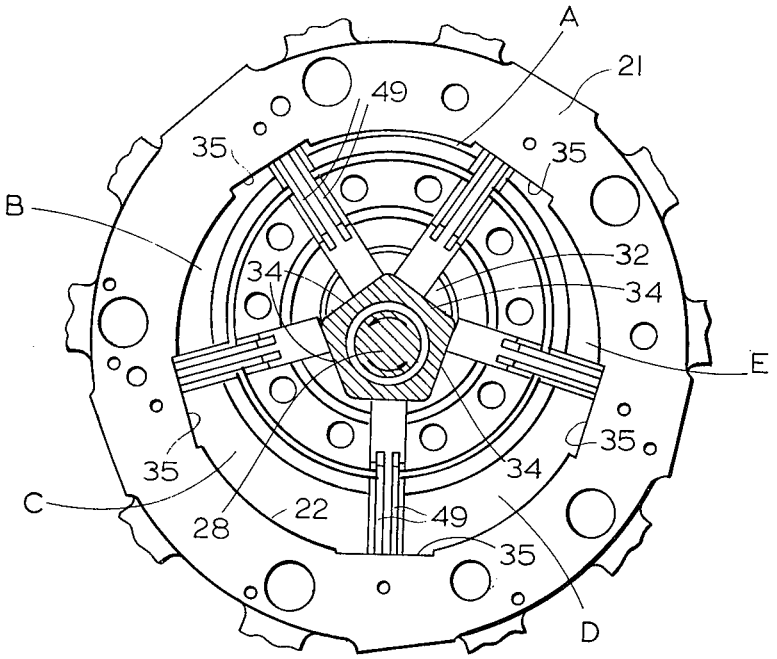
FIG. 4 is a transverse elevation taken at line 4—4 in FIG. 3.

FIG. 3 provides a longitudinal sectional view of the engine in which the frame 12 is made up of an annular member 21 formed with an internal generally cylindrical wall 22, an end member 23 having a flat face 24 enclosing the combustion chamber and an intermediate member 25 also having a flat face 26 completing the enclosure for the combustion chamber. A second end member 27 is attached to the member 25. A crankshaft 28 is operatively mounted in the frame in a bearing adapter 29 at the power output gear 30, and by a thrust bearing 31 mounted in the second end member 27. The crankshaft 28 is supported by an intermediate bearing 32 disposed in the intermediate member 25, and the eccentric element 33 of the crankshaft is disposed between the frame members 23 and 25, and more particularly adjacent the inner end 29A of the bearing adapter 29. As is seen in FIG. 4, the inner end of geometric member 29A is formed with a plurality of flat surfaces 34 which are aligned in parallel relation with radially outwardly disposed flat surfaces 35 in the peripheral surface of the annular frame member 21. In the embodiment shown there are five flat surfaces 34 on the adapter end 29A and a like number of surfaces 35 in the member 21.

Figure 8:
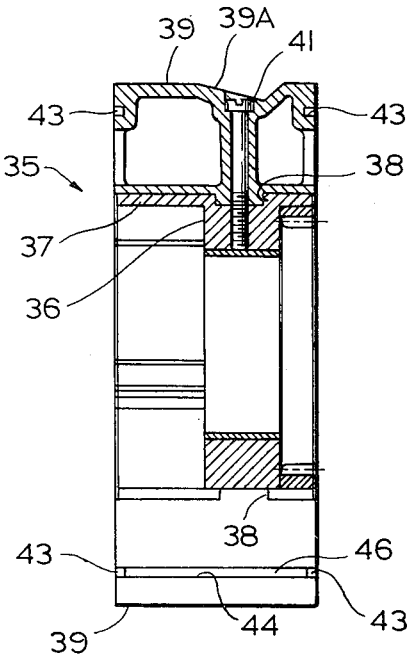
FIG. 8 is a sectional view of the piston taken at line 8—8 in FIG. 7.
Figure 7:
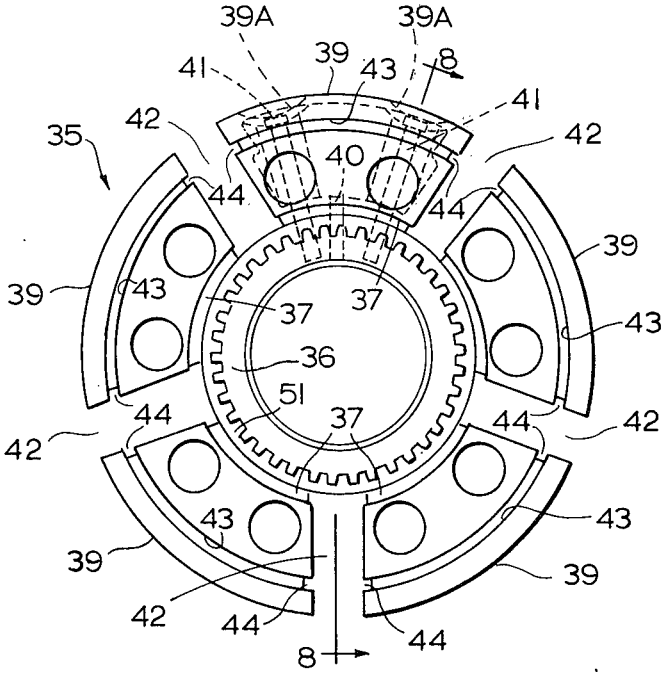
FIG. 7 is an elevational view of the piston to show certain details of its construction.

The piston 35 for this engine is best seen in FIGS. 7 and 8, and its operating position is seen in FIG. 3 and in other views. The piston 35 has a core ring body 36 which is operatively mounted on the eccentric 33 on the crankshaft 28. The ring body 36 is formed with five circumferentially spaced mounting bases 37 which extend axially outwardly at each side of the ring 36, and each base has a circumferentially directed notch 38 for the purpose of locating the several face segments 39 of the piston 35. Each segment 39 is further located on the ring 36 by a dowl pin 40 (FIG. 7), and bolts 41 secure each face segment in the desired location so that there are radially directed recesses 42 separating each thereof. The segments 39 have valve clearance recesses 39A which also occur where the heads of the bolts 41 are situated. Furthermore, each segment 39 is formed with slots 43 in the opposite side faces and aligned slots 44 in the facing surfaces of the recesses 42. The slots 43 receive seal blades 45 (FIG. 3) and slots 44 receive blades 46 (FIG. 8).

The piston 35 of FIGS. 7 and 8 is provided with a vane in each recess 42, and a typical vane is seen in FIG. 3 where the vane has a body 47 with a radially inwardly directed extension 48 which is engaged on the adjacent flat surface 34 on the adapter end 29A. The outer end of the vane body 47 engages a flat surface 35 in the cylindrical wall 22 (FIG. 4) of the frame member 21. Each vane body 47 is provided with pairs of side seal blades 49 and end seal blades 50. The side seal blades 49 (FIG. 3) have portions 49A that extend into cooperative engagement with the blades 50, and all of the seal blades are supported in suitable slots on wave-type springs which press the blades against the side and end surfaces of the chamber occupied by the orbiting piston 35.

Figure 2:
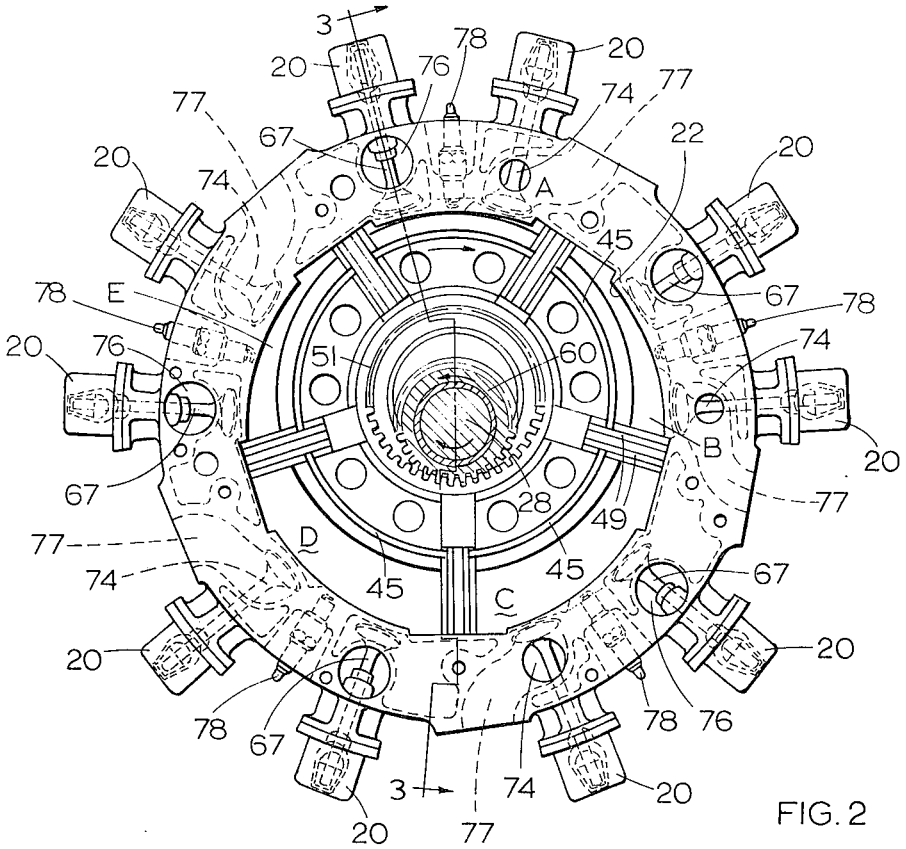
FIG. 2 is a transverse elevation taken at line 2—2 of FIG. 3.

Turning now to FIGS. 2, 3 and 7 it will be appreciated that the piston 35 carries a first elemement or ring gear 51 while the crankshaft 28 carries a second element or gear 52 (FIG. 6) fixed thereon. Piston motion control means interconnects these elements, and consists in gear 52 meshing with a gear 53 operatively fixed on a shaft 54 mounted in the frame member 25. The shaft 54 drives a pinion gear 55 (FIG. 5) as well as a meshing idler gear 56 on a separate shaft 57 carried in the frame member 25 but not shown except as to its position relative to shaft 54. The idler gear 56 meshes with gear 58 on a sleeve 59 which is free to rotate on the crankshaft 28 (FIG. 3). The sleeve 59 also has a gear 60 thereon which meshes with the ring gear 51 on the piston 35. This gear train is unique in the respect that it retards the motion of the piston 35 and forces it to orbit. It is appreciated that the principal torque on the crankshaft 28 is derived from the piston driving the eccentric 33. In certain engines where the piston actually rotates, the gear 60 would normally be stationary thereby causing the piston to rotate around the crankshaft. However, in this instant assembly gear 60 is free to rotate relative to the crankshaft 28 and when gear 60 is caused to rotate oppositely to the crankshaft 28 it will retard the tendency of the piston 35 to rotate and hold it in an orbital motion. The advantage is to avoid having the vanes 47 sweep around in the annular chamber and move across the inlet and exhaust valve openings, as required by earlier rotary piston engines.

Figure 5:
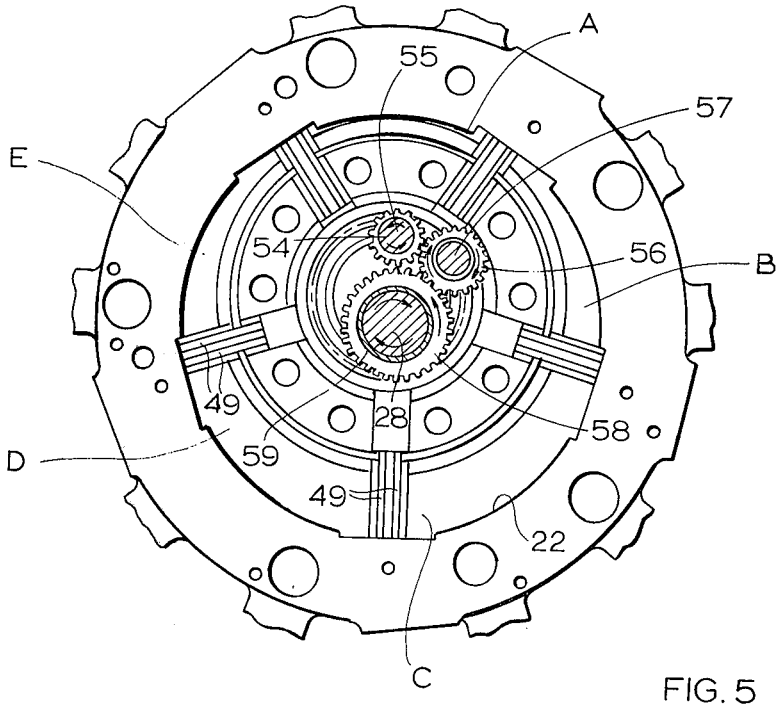
FIG. 5 is a transverse and partly sectioned view taken along line 5—5 in FIG. 3.
Figure 6:
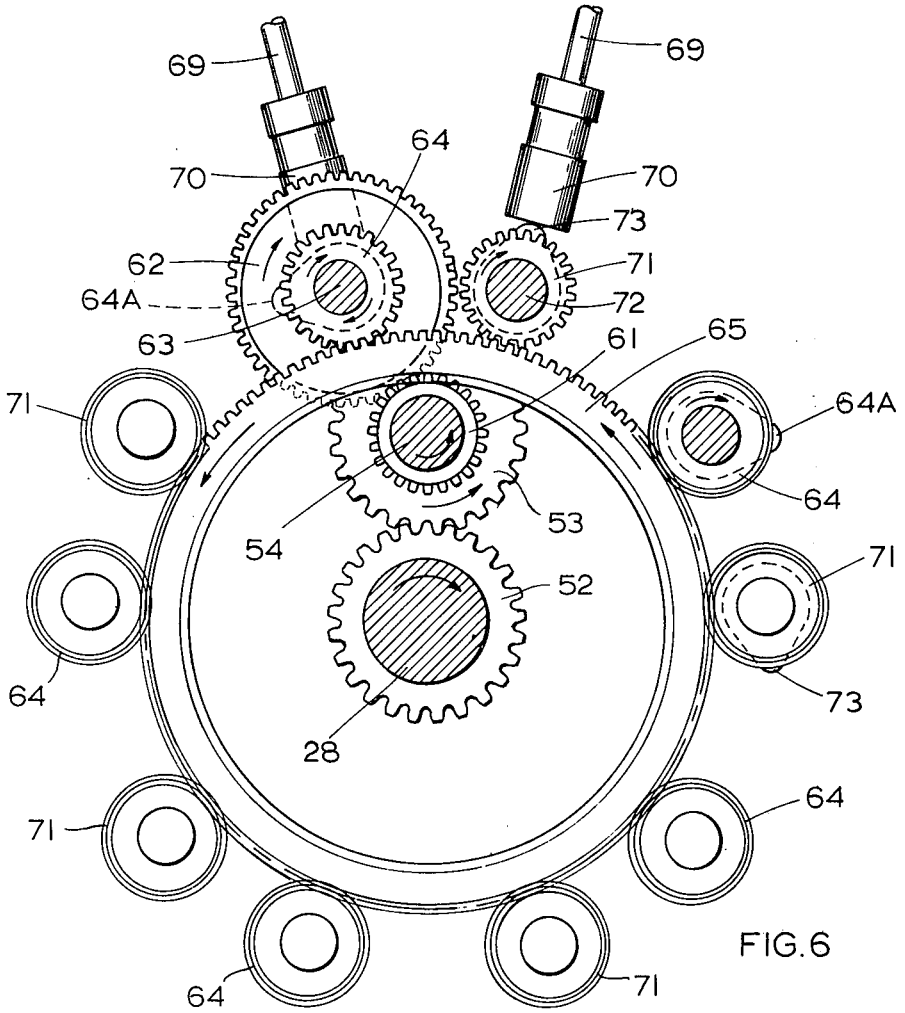
FIG. 6 is a further transverse and partly sectioned view taken along line 6—6 in FIG. 3.

The action of the gear assembly of FIGS. 3, 5 and 6 is as follows: as the piston 35 rotates the crankshaft 28 it will immediately cause gear 52 to rotate and this sets the gear 53 in motion to drive shaft 54. When the shaft

54 rotates it drives gear 55 (FIG. 5) and that drives idler gear 56, which, in turn, drives sleeve 59 which carries gears 58 and 60. Gear 60 rotates on the crankshaft 28 opposite to the direction of crankshaft rotation. The gear ratios are such that the gear 60 rotates counterclockwise (FIG. 5) through ninety degrees while the piston ring gear 51 moves clockwise through 180°. The retarding effect of gear 60 on the ring gear 51 and piston 35 is to oppose rotation of the piston and effectively keep the piston in an orbiting gyration in the annular chamber of the frame. This result is achieved by the positive reverse drive of gear 60 from crankshaft gear 52 back through shaft 54 and idler gear 56 (FIG. 5) to the sleeve gears 58 and 60 and into the piston ring gear 51. The ratio of gears 55 and 58 is 2 to 1 so that the piston retardation will be sufficient to keep it in a wobble and rotation-free orbiting motion.

The drive to shaft 54 by gears 52 and 53 effects rotation of gear 61 (FIGS. 3 and 6) which drives a larger idler gear 62 on shaft 63. The shaft 63 drives gear 64 which, in turn, drives a cam ring gear 65 mounted on a bearing seat 66 in the frame end member 27 at the front of the engine frame.

The cam ring gear 65 meshes with each of five similar gears 64 spaced about the frame to operate cams 64A for the inlet valves 67. Each inlet valve 67 is operated by a rocker arm 68 (FIG. 3) under the cover 20, and a push rod 69 and lifter 70. In like manner, the ring gear 65 meshes with each of five similar gears 71 on shaft 72, and these shafts 72 operate cams 73 for actuating the exhaust valves 74. The latter valves are actuated by a suitable push rod, lifter and rocker arm assembly of the character shown for the inlet valves 67 (see FIG. 6). The fuel-air inlet manifolds are not shown, but may be of any suitable configuration to supply the combustion mixture to the intake passages 76 (FIG. 2). Similarly, the exhaust passages 77 are to be connected to a suitable exhaust manifold system (not believed necessary to show). The manner of arranging the various frame members and working components is easily seen in FIGS. 1, 2 and 3, and it is especially to be noted that the piston 35 and vanes 47 form five combustion chambers A, B, C, D and E (FIG. 2), each with a spark igniter plug 78.

Figure 9:
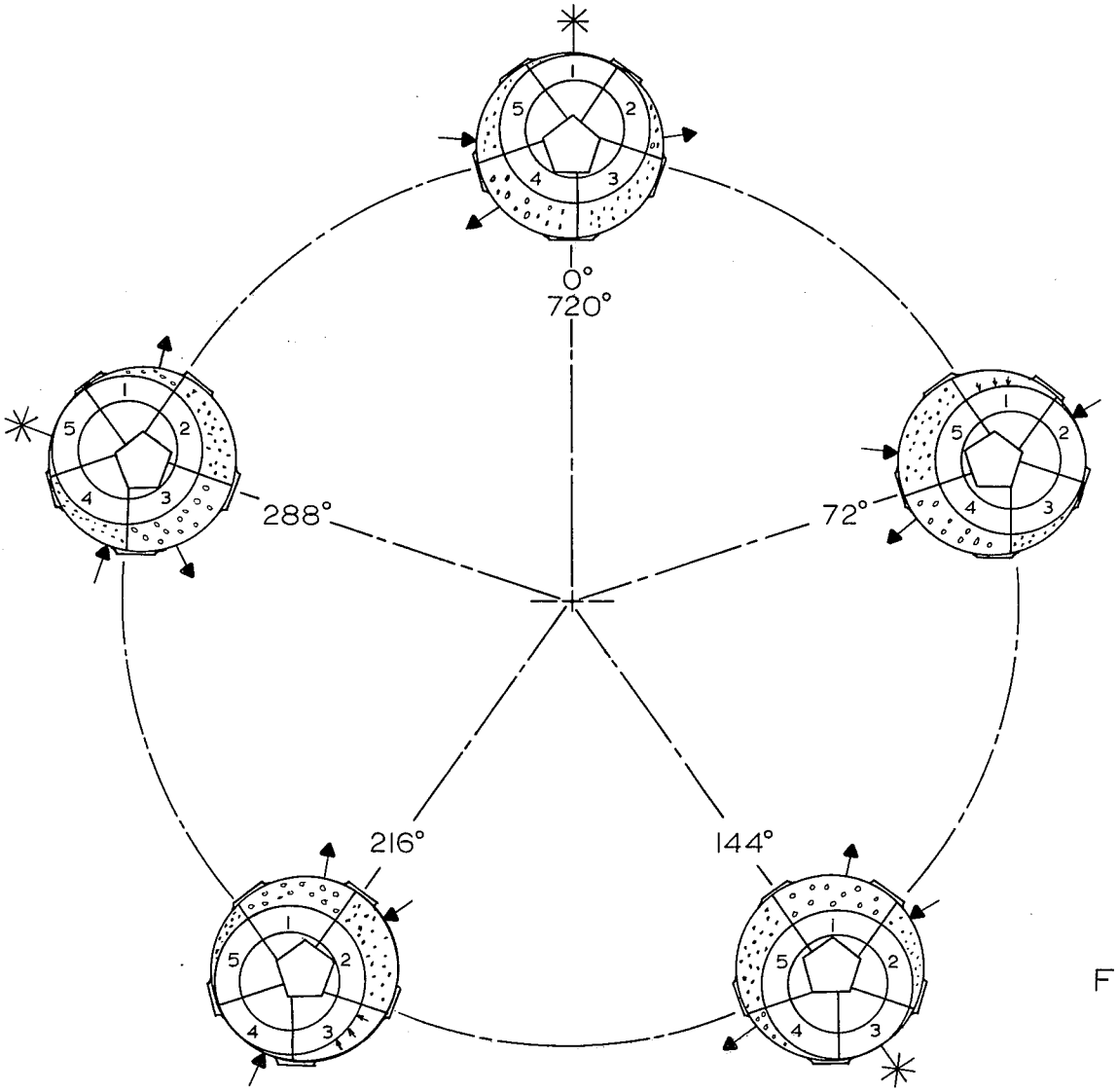
FIGS. 9 and 10 are schematic diagrams of the firing order for the present engine embodiment, the diagrams presenting two complete orbits of the piston.
Figure 10:
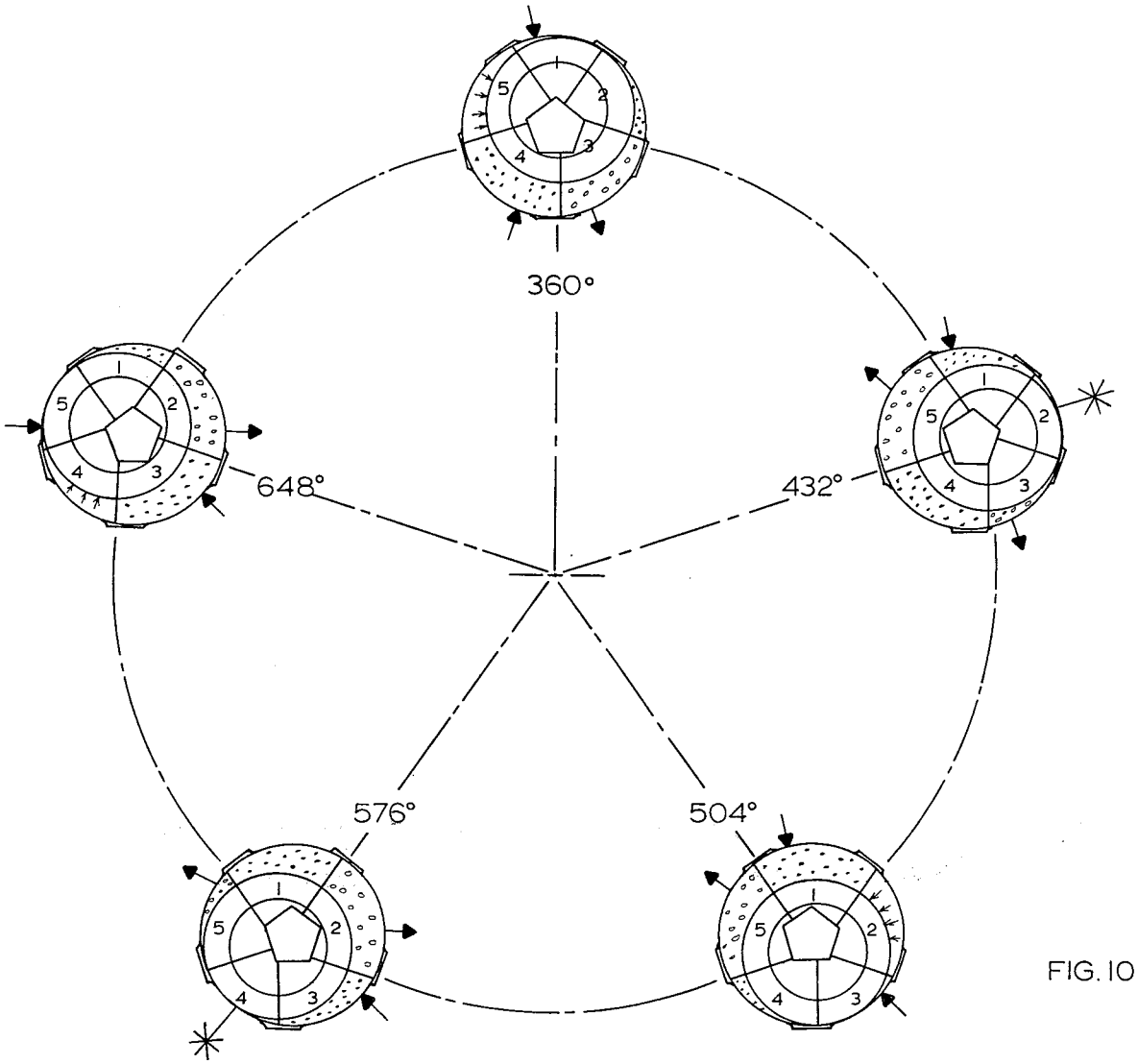

FIGS. 9 and 10 are schematic diagrams of the firing order for the engine as seen in FIG. 2. It is necessary to understand from FIG. 5 that the orbiting piston 35 is intended to move in a clockwise direction. The crankshaft 28 rotates in a clockwise direction, and the shaft 54 and its gear 53 rotate counterclockwise. The cam drive gears 64 and 71 (FIG. 6) rotate in a clockwise direction as each is driven from a common gear 65. The result is that the cams 64A and 73 also rotate in a clockwise direction. In a five cell orbital piston engine, the working face of the segments 39 in each cell extends over about 72°. Therefore, the location of the valves and igniter plug is repeated every 72° so that the diagrams of FIGS. 9 and 10 show the position of the piston 35 at every 72° for two complete orbits. The events of compression, ignition and expansion, exhaust, and intake are illustrated in FIGS. 9 and 10, but are better understood when considered in conjunction with the following chart of the events taking place in each cell A, B, C, D and E for two complete orbits of the piston 35 when operating on the 4-cycle principle.

| ANGLE | CELL A | CELL B | CELL C | CELL D | CELL E |
|---|---|---|---|---|---|
| 0° | POWER* | EXHAUST | COMPRESS | EXHAUST | INTAKE |
| 72° | POWER | INTAKE | COMPRESS | EXHAUST | INTAKE |
| 144° | EXHAUST | INTAKE | POWER* | EXHAUST | COMPRESS |
| 216° | EXHAUST | INTAKE | POWER | INTAKE | COMPRESS |
| 288° | EXHAUST | COMPRESS | EXHAUST | INTAKE | POWER* |
| 360° | INTAKE | COMPRESS | EXHAUST | INTAKE | POWER |
| 432° | INTAKE | POWER* | EXHAUST | COMPRESS | EXHAUST |
| 504° | INTAKE | POWER | INTAKE | COMPRESS | EXHAUST |
| 576° | COMPRESS | EXHAUST | INTAKE | POWER* | EXHAUST |
| 648° | COMPRESS | EXHAUST | INTAKE | POWER | INTAKE |

POWER: Ignition and expansion, all valves closed
IGNITION: *
EXHAUST: Exhaust valve open, inlet valve closed
INTAKE: Inlet valve open, exhaust valve closed
COMPRESSION: All valves closed The above chart illustrates the substantially uniform development of power from each cell, with an overlap as the expansion in one cell continues until ignition has occurred in the next cell. The firing order according to the designation of the cells in FIGS. 5, 9 and 10 is the following: A, C, E, B, D. It is, of course, understood that the valves for a given cell will be closed during the period of compression and power, the exhaust valve will than open and finally the intake valve will open when the exhaust valve closes. The cams for the intake and exhaust valves for a given cell will be oriented so that the four cycles above outlined take place in proper sequence and during the proper angular position of the piston 35. Generally, the piston moves through an angle of 180° during compression, an angle of 180° during ignition and power delivery, an angle of 180° during the exhaust, and an angle of 180° during suction. The exhaust valve cam 71 for cell A (FIG. 6) will have its lobe oriented so that when the piston 35 (FIG. 9) reaches the bottom position 180° from top dead center (TDC) the lobe will begin to open the exhaust valve 74. That lobe orientation will be about 135° away from a position directly under the lifter 70 and the exhaust valve 74 will close when the lobe has traveled another 45°. Thereafter, the valve will remain closed for about 270° of cam rotation which is about 540° of piston movement. The exhaust cams 73 for the other valves 74 will function in the same manner, but progressively later in angular orientation by 72°, and the inlet valve cam 64A, for example, for cell A will be oriented so that its lobe will trail the exhaust cam lobe by about 90°. It is believed unnecessary to show the cam orientation for each of the cells B, C, D and E, as this will be clearly understood from the description for cell A.

What is claimed is:

1. In an internal combustion engine the combination of frame means forming an annular combustion chamber, piston means in said chamber, sealing vanes carried by said piston means to engage with said chamber and form distinct combustion cells therein, a crankshaft extending axially through said chamber and rotatively mounted in said frame means, an eccentric fixed on said crankshaft and operatively engaged with said piston means, said piston means driving said crankshaft and moving relative to said chamber, and piston motion control means responsive to crankshaft rotation for holding the relative motion of said piston means to an orbital path in said chamber, said piston motion control means consisting of a first element on said piston, a second element on said crankshaft, and interengaged means operative between said first and second elements to nullify the tendency of said piston to rotate in the direction of crankshaft rotation and thereby generate the orbital motion of said piston means.

2. In an internal combustion engine the combination of frame means forming an annular combustion chamber, piston means in said chamber, sealing vanes carried by said piston means to engage with said chamber and form distinct combustion cells therein, a crankshaft extending axially through said chamber and rotatively mounted in said frame means, an eccentric fixed on said crankshaft and operatively engaged with said piston means, said piston means driving said crankshaft and moving relative to said chamber, and piston motion control means responsive to crankshaft rotation for holding the relative motion of said piston means to an orbital path in said chamber, said piston motion control means consists of a first gear fixed to said piston, a second gear fixed to said crankshaft, and a gear train operatively connecting said first and second gears, said gear train being operative on said piston to generate said orbital motion upon crankshaft rotation.

3. The internal combustion engine combination recited in claim 2 wherein inlet and exhaust valves are operatively mounted in said frame to communicate with said annular combustion chamber, operating cams are adjacent said valves, and a second gear train operatively connects said cams with said first mentioned gear train.

4. In an internal combustion engine the combination of a frame assembly defining an annular chamber having a peripheral wall and spaced opposed sidewalls, a principal shaft supported in said frame assembly for rotation about an axis centered to said peripheral wall, an eccentric on said principal shaft and aligned with said annular chamber, a piston mounted on said eccentric and having an operating fit between said opposed sidewalls, said piston having a peripheral face opposed to said peripheral wall, sealing vanes carried by said piston and extending into sealing engagement with said peripheral and side walls, said vanes dividing said piston peripheral face and said chamber peripheral wall into distinct combustion cells, and operating means between said principal shaft and said piston effective to cause said piston to move with an orbital motion during rotation of said eccentric and said principal shaft, said operating means being a gear assembly which includes a gear on said piston, a gear on said principal shaft and interconnecting gears driven by said principal shaft gear and driving said piston gear in a direction to establish said orbital motion of said piston.

* * * * *